US007096647B2

(12) United States Patent
De Barbuat et al.

(10) Patent No.: US 7,096,647 B2
(45) Date of Patent: Aug. 29, 2006

(54) SYSTEM FOR PACKAGING PRODUCTS WITH IMMOBILIZATION BY MEANS OF SHRINK FILM

(75) Inventors: Charles-Antoine De Barbuat, Dijon (FR); Frédéric Mancion, Paris (FR); Joël Foulon, Combertault (FR)

(73) Assignee: Savoye (S.A.), Dijon (FR)

( * ) Notice: Subject to any disclaimer, the term of this patent is extended or adjusted under 35 U.S.C. 154(b) by 218 days.

(21) Appl. No.: 10/811,957

(22) Filed: Mar. 30, 2004

(65) Prior Publication Data

US 2004/0245141 A1 Dec. 9, 2004

(30) Foreign Application Priority Data

Apr. 29, 2003 (FR) ..... 03 05257

(51) Int. Cl.
*B65B 53/02* (2006.01)

(52) U.S. Cl. ..... 53/441; 53/474

(58) Field of Classification Search ..... 53/441, 53/442, 473, 474, 556, 557; 206/497, 583
See application file for complete search history.

(56) References Cited

U.S. PATENT DOCUMENTS

| | | | | |
|---|---|---|---|---|
| 3,949,868 | A * | 4/1976 | Allen | 206/497 |
| 4,133,430 | A * | 1/1979 | Cravens | 206/497 |
| 4,328,896 | A * | 5/1982 | Behne | 53/441 |
| 4,757,900 | A * | 7/1988 | Misset et al. | 53/442 |
| 5,086,925 | A * | 2/1992 | Coalier et al. | 53/442 |
| 6,010,003 | A * | 1/2000 | Wilkinson | 206/497 |
| 6,010,006 | A * | 1/2000 | Ridgeway et al. | 206/583 |
| 6,216,871 | B1 * | 4/2001 | Bacques et al. | 53/442 |
| 6,223,901 | B1 * | 5/2001 | Lofgren et al. | 206/583 |
| 6,264,034 | B1 * | 7/2001 | Bacques et al. | 53/442 |

FOREIGN PATENT DOCUMENTS

| | | | |
|---|---|---|---|
| EP | 0 577 457 A1 | | 1/1994 |
| EP | 0 697 338 A1 | | 2/1996 |
| FR | 2 589 444 | | 5/1987 |
| FR | 2 593 781 | | 8/1987 |
| FR | 2 703 656 | | 10/1994 |
| FR | 2 601 654 | | 1/1998 |
| FR | 2 759 672 | | 8/1998 |
| FR | 2 769 591 | | 4/1999 |
| JP | A-11-105858 | | 4/1999 |
| WO | WO 87/02644 | * | 5/1987 |

* cited by examiner

*Primary Examiner*—Louis Huynh
(74) *Attorney, Agent, or Firm*—Oliff & Berridge, PLC

(57) ABSTRACT

The system uses a shrink film covering all the products (12) arranged inside a cardboard box (1) and holding these products against one another and also against the base (2) of the box. At least two heat-shrinkable sheets (9, 10) are attached, by one of their edges, in the region of the join between the base (2) of the box and the sides (4) of the lateral band (3) of this box. An additional heat-shrinkable sheet (14), supplied at the upper level of the lateral band (3) or of the products (12), is joined by welding to the previous sheets (9, 10) in order to form a single film that is shrunk over the products (12). A heat-protection sheet (13) may be inserted between this film and the products (12). The invention applies to packaging for the preparation and dispatch of product orders.

10 Claims, 4 Drawing Sheets

SYSTEM FOR PACKAGING PRODUCTS WITH IMMOBILIZATION BY MEANS OF SHRINK FILM

BACKGROUND OF THE INVENTION

Generally speaking, the present invention relates to the field of the packaging of products inside cardboard boxes, for preparing and dispatching product orders. More particularly, this invention relates to a system for packaging products with immobilization by means of a shrink film covering all the products arranged inside a cardboard box and, after its shrinking, holding these products against one another and also against the base of the box. Even more especially, the invention relates to a packaging system that uses cardboard boxes comprising a base and a lateral band in cardboard and sheets in heat-shrinkable material attached, via one of their edges, in the region of the join between the base of the box and at least two sides of the lateral band of this box.

DESCRIPTION OF THE PRIOR ART

A packaging system of this type is known, in particular, from French patent 2 589 444 and also from French patent 2 593 781.

In the systems disclosed in these two documents, provision is made for two sheets of heat-shrinkable plastic that are connected, respectively, via their border zones, to the joining regions of the base of the box and of two opposing faces of the lateral band of the box.

The two sheets of plastic extend inside the box, from their respective zones of connection to said box. In order to fill the package with the products to be packaged, the initially free parts of the two sheets of plastic are firstly folded down outward, over the upper edge of the lateral band of the box. After the box has been filled with the products to be packaged, the initially free parts of the two sheets of plastic are brought toward the inside of the box, over the previously positioned products, where these sheets will overlap. The two sheets are then welded to one another in their overlapping zone so as to form a single film covering all the products. The application of heat for the welding also gives rise to the shrinking of this film, thereby enclosing all the products together. Lastly, the box may be closed by a lid or a cover in cardboard.

As will be easily understood, a packaging system of this type, using two heat-shrinkable sheets connected, respectively, to two opposing sides of the box, requires heat-shrinkable sheets of sufficient length for it to be possible for them to join up and overlap over the products placed inside the box. The result of this is that, when the two sheets are folded down outward with a view to filling the box with the products to be packaged, the outer parts of the two sheets are themselves of significant length, which involves a number of drawbacks:

On the one hand, the outer parts of the two heat-shrinkable sheets, which are not usually held, hang freely and may assume more or less abnormal positions, possibly not clearing the upper opening of the box fully such that they constitute a hindrance for the operator filling said box. These hanging parts also risk disrupting the smooth circulation of the box along a conveyor.

Furthermore, the operation consisting of supplying the two sheets toward the inside of the box, over the products that have been positioned, and with overlapping, requires a fairly significant amount of handling, which is time-consuming, this operation still being done entirely by hand.

Furthermore, when the heat-shrinkable sheets are temporarily folded down toward the outside of the box, and if the height of the hanging parts of the sheets is considerable, there is a possibility that these parts of the sheets will cover labels fixed to the band of the box and thus impede reading of such labels.

These drawbacks are reflected in a reduction in productivity in terms of the operation of filling the boxes and placing the products to be packaged under heat-shrinkable film. There may also be a resultant insufficient immobilization of the products when the sheets are poorly folded down prior to their welding and shrinking.

SUMMARY OF THE INVENTION

The present invention aims to eliminate all these drawbacks, particularly with a view to improving productivity while still guaranteeing reliable immobilization of the packaged products. A supplementary object of the invention is to protect these products from heat during the operation of heat-shrinking the film.

To this end, a subject of the invention is essentially a system for packaging products with immobilization by means of shrink film, of the type specified in the introduction, in which, in addition to the sheets in heat-shrinkable material attached to the region of the join between the base of the box and the lateral band of this box, provision is made for an additional heat-shrinkable sheet brought to the level of the upper part of the lateral band or of the products and connected by means of welding to the previous heat-shrinkable sheets in order to form a single film that is shrunk over the products arranged inside the box, in order to immobilize them.

Preferably, the additional heat-shrinkable sheet has a rectangular shape corresponding to the horizontal section of the cardboard box.

Customarily, in the case of a cardboard box provided with two heat-shrinkable sheets attached, respectively, in the region of the join between the base of the box and two opposing faces of the lateral band of this box, the additional heat-shrinkable sheet is welded to the first two heat-shrinkable sheets along two parallel lines so as to form, by means of the joining of the three sheets, a continuous heat-shrinkable strip.

Insofar as the three sheets used consist of uniaxially oriented heat-shrinkable plastic, the orientation directions of these three sheets are coordinated, in particular in the transverse direction of the box.

The additional heat-shrinkable sheet may be joined to the first heat-shrinkable sheets by continuous welding lines. The joining of these sheets forms, in this case, a continuous-surface single film.

In a variant embodiment, the additional heat-shrinkable sheet is joined to the first heat-shrinkable sheets by discontinuous welding lines. In this way, after shrinkage of the film, lines of least resistance are formed that can facilitate access to the packaged products, without a cutting tool and thus with no risk of injury or spoiling these products.

The additional heat-shrinkable sheet may be a sheet of the same nature, thickness and color as the first heat-shrinkable sheets, which makes it possible to form a uniform film by means of the joining of all these sheets.

However, it may also be advantageous to use an additional heat-shrinkable sheet whose nature and/or thickness and/or color is different than those of the first heat-shrinkable sheets. Such differentiation makes it possible to optimize costs and, above all, the qualities required for good film shrinkage. In particular, the use of an additional sheet in a dark color promotes shrinkage of said sheet in an infrared tunnel.

According to one embodiment of the packaging system that is the subject of the invention, a heat-protection sheet particularly made of paper, is inserted between the assembly of products arranged inside the box on the one hand and the continuous film formed by the joining of the heat-shrinkable sheets on the other. In particular, the heat-protection sheet has a rectangular shape corresponding to the horizontal section of the cardboard box and to the surface of the additional heat-shrinkable sheet. Of course, this heat-protection sheet must be capable of following the shape of the packaged products.

The present invention also relates to the method for implementing this additional heat-shrinkable sheet and, if appropriate, the heat-protection sheet.

Thus, according to another aspect of the invention, a subject of the latter is a method for forming packaging for products with immobilization by means of a shrink film of the type in question here, in which, starting from a preformed cardboard box, in succession:

the initially free parts of heat-shrinkable sheets connected to the region of the join between the base of the box and the lateral band of this box are folded over the upper edge of faces of the cardboard lateral band of the box that is still without its cover;

the products to be packaged inside the box are inserted;

the additional heat-shrinkable sheet is placed over the box or into the latter;

the additional heat-shrinkable sheet is welded to the first heat-shrinkable sheets, at the level of the upper part of the corresponding faces of the lateral band or over the products arranged inside the box, so as to form a single continuous film; and this film is shrunk, by means of heating, so as to tighten it over all the products arranged inside the box.

The operations of welding the additional heat-shrinkable sheet to the first heat-shrinkable sheets and of shrinking the film resulting from the joining of these sheets are carried out either in succession or simultaneously, which can easily be envisaged since said sheets are made from heat-shrinkable material.

If a heat-protection sheet has to be inserted it is placed inside the box after insertion of the products to be packaged and before insertion of the additional heat-shrinkable sheet.

According to a preferred embodiment of this method, the parts of the first heat-shrinkable sheets folded over against the outside of the corresponding faces of the lateral band of the box are held temporarily against the outside of these faces by means of adhesive bonding or by pinching, at least during the step of inserting the products to be packaged.

The additional heat-shrinkable sheet can be supplied by unwinding from a reel of heat-shrinkable film and by cutting this film above a location receiving the box, in particular above a conveyor. This thus constitutes a work station, which not only unwinds and cuts the film stored on the abovementioned reel, but advantageously also welds the additional heat-shrinkable sheet to the first heat-shrinkable sheets.

In the case of the use of a heat-protection sheet, this sheet can also be supplied by unwinding from a reel of protective strip and by cutting this strip above a location receiving the box, in particular above the conveyor. This thus forms a station for positioning the heat-protection sheet, supply of this heat-protection sheet taking place before the supply and welding of the additional heat-shrinkable sheet.

Overall, the packaging system that is the subject of the invention considerably improves upon the current systems referred to in the introduction and in particular affords the following advantages:

the use of an additional heat-shrinkable sheet makes it possible to shorten the first heat-shrinkable sheets, which no longer have to overlap above the products to be packaged, and this reduces the height of the parts of these sheets that hang outside and thus removes the hindrance that these hanging parts constitute;

this advantage is further reinforced if the parts of the first heat-shrinkable sheets, folded down on the outside, are temporarily held against the corresponding faces of the lateral band of the box;

the substantial shortening of the parts of the first heat-shrinkable sheets, folded down on the outside, thus guarantees that the labels on the lateral faces of the box can be seen;

given the linking of the first heat-shrinkable sheets to the additional heat-shrinkable sheet by means of welding, the continuous film formed by the joining of these sheets can take place automatically inside the box, during shrinkage thereof, without it being necessary to supply sheets manually toward the inside of the box;

the operations of positioning the additional heat-shrinkable sheet and, if appropriate, the heat-protection sheet may easily be automated;

overall, given all the aforesaid, the packaging system that is the subject of the invention leads to a significant increase in productivity without the quality of immobilization of the products being reduced;

lastly, in the case of the use of a heat-protection sheet, the products placed inside the box are protected during the film-shrinkage operation in the case where these products could be adhesively bonded to the shrunk film.

BRIEF DESCRIPTION OF THE DRAWINGS

The invention will be better understood with the aid of the following description, with reference to the appended diagrammatic drawing that represents, by way of example, an embodiment of this system for packaging products with immobilization by means of shrink film.

DESCRIPTION OF THE PREFERRED EMBODIMENTS

Figure 1:
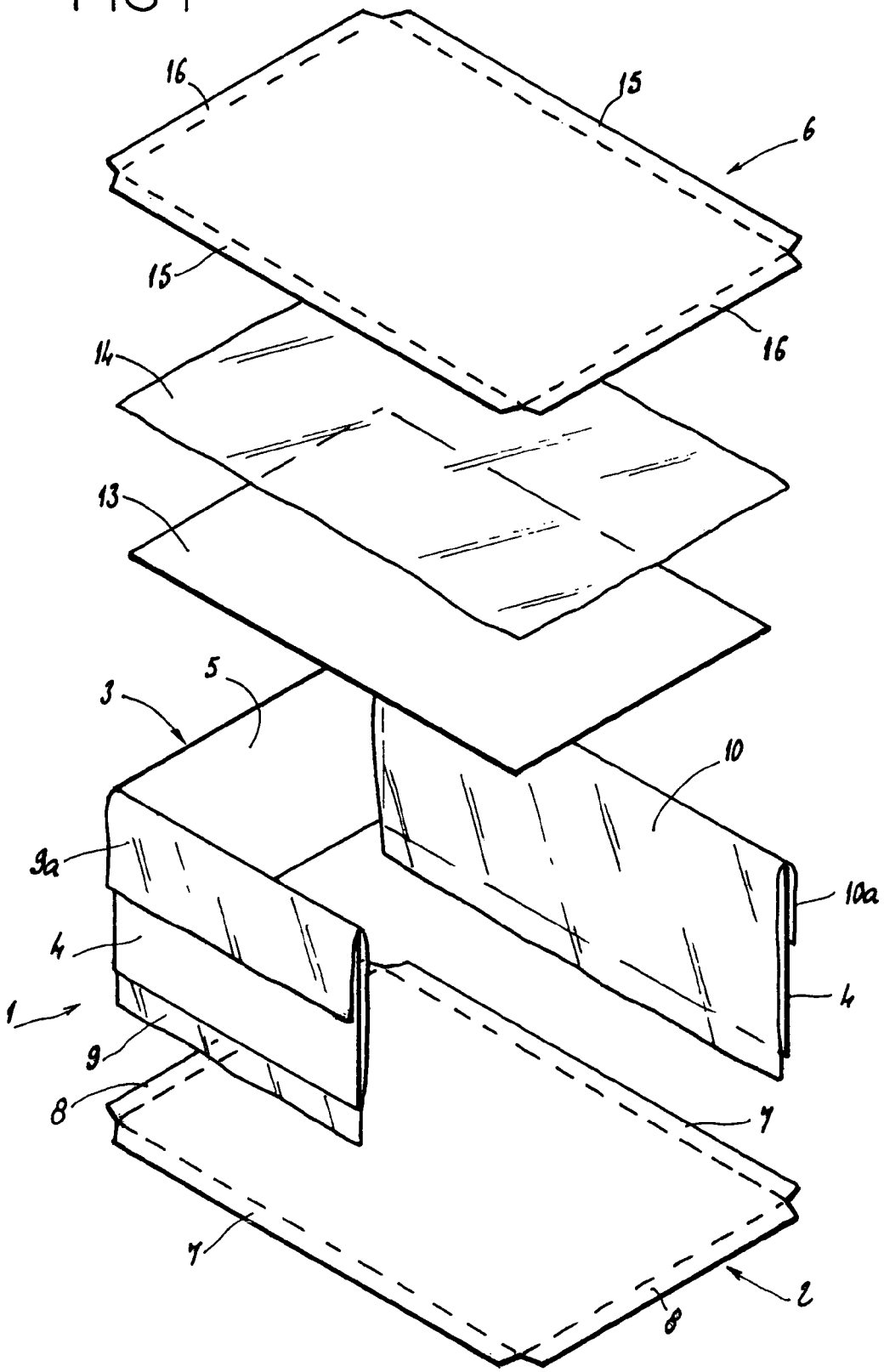
FIG. 1 is an exploded perspective view of a cardboard box and of the other components, implementing the packaging system that is the subject of the invention.

The packaging system illustrated in the drawing makes use of a cardboard box 1, of general parallelepipidal shape, comprising: a rectangular base 2, a lateral band 3 forming the four vertical faces of the box 1, namely two opposing vertical larger faces 4 and two opposing vertical smaller faces 5, and a rectangular cover 6 closing the box 1 in its upper part.

The rectangular base 2 includes, on its edges, two longitudinal flaps 7 and two transverse flaps 8, which are raised and applied, respectively, against the lower parts of the larger faces 4 and smaller faces 5 of the lateral band 3. The flaps 7 and 8 are, in this case, applied and fixed by means of adhesive bonding to the outer side of the lateral band 3.

Two rectangular sheets 9 and 10, made from heat-shrinkable plastic, are connected, respectively, via their border zones to the regions of the join of the base 2 of the box 1 and the two opposing larger faces 4 of the lateral band 3. To this end, in a manner known per se, the border zones of the two sheets 9 and 10 are folded under the lower edges of the corresponding larger faces 4 of the lateral band 3, and these folded border zones are fixed, in particular pinched and adhesively bonded, between said larger faces 4 and the corresponding, raised, flaps 7 of the base 2. Of course, during the process of forming the box 1, adhesive bonding of the border zones of the two sheets 9 and 10 against the outside of the larger faces 4 of the lateral band 3 takes place before the positioning and adhesive bonding of the base 2 to the bottom of the lateral band 3.

Figure 2:
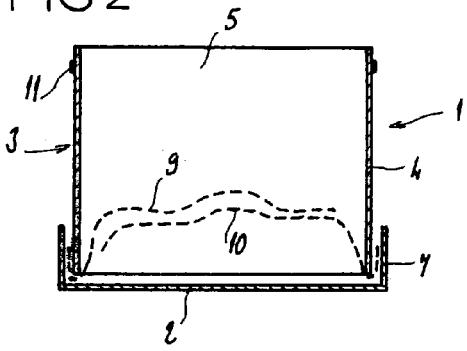
FIGS. 2 to 9 are diagrams, in vertical section, illustrating the successive steps of the method for filling and forming the packaging according to the present invention.

FIG. 2 shows the box 1 as it appears upon exiting the forming machine, with its two sheets 9 and 10 fixed as just indicated and extending inside this box 1, the cover not yet being positioned, such that the box 1 is open in its upper part. Starting from this position, and with reference to the diagrams of the following FIGS. 3 to 9, a description will now be given of the remainder of the process, which comprises filling the box 1 with products to be packaged and immobilizing said products.

Figure 3:
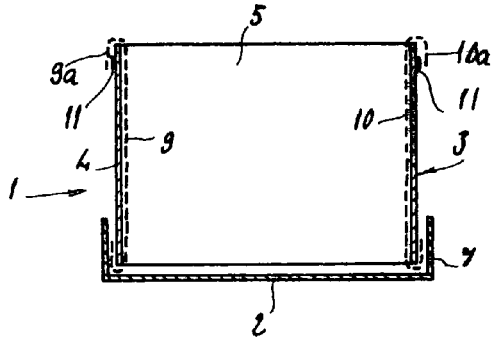

As FIG. 3 shows, the two sheets 9 and 10 made from heat-shrinkable plastic are firstly raised, against the inner sides of the larger faces 4 of the lateral band 3, and the free end parts of these two sheets 9 and 10 are folded down, over the upper edges of the two faces 4, toward the outside of these two faces 4. The outer parts 9*a* and 10*a* of the two sheets 9 and 10, which then face the upper parts of the corresponding two faces 4 of the lateral band 3, are held against the outside of these faces 4 at temporary joining points indicated symbolically at 11. These joining points 11 are:

either adhesive dots produced with a viscous adhesive that does not produce excessive adhesion;

or pinching points, the outer parts 9*a* and 10*a* of the two sheets 9 and 10 being held in appropriate slits, notches or impressions produced in the upper zone of the larger faces 4 of the cardboard lateral band 3.

It will be noted that the height of the outer parts 9*a* and 10*a* of the two sheets 9 and 10 in this case remains relatively small, by virtue of appropriate sizing of these two sheets 9 and 10.

Figure 4:
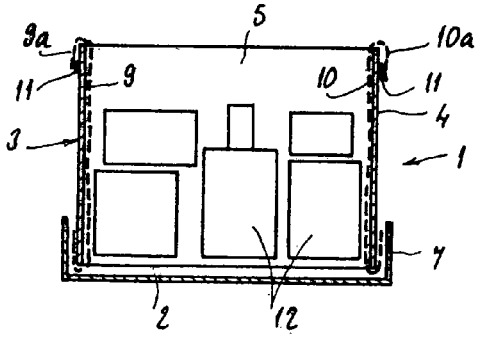

Next, as illustrated in FIG. 4, the box 1 is filled with products 12 to be packaged. The products 12 are inserted via the upper opening of the box 1, which is completely clear thanks to the two sheets 9 and 10 being held, and these products are placed on the base 2 of the box 1 and/or stacked on one another, without rising beyond the top of the lateral band 3.

Figure 5:
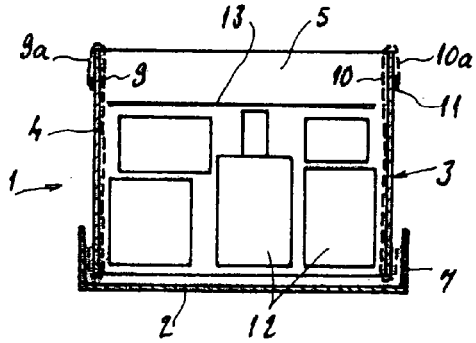

After the box 1 has been filled with products 12, the next, optional step, as FIG. 5 shows, is to supply and position an optional heat-protection sheet 13. Of rectangular shape and consisting, for example, of paper, the protection sheet 13 is inserted via the upper opening of the box 1 and positioned above all the products 12.

Figure 6:
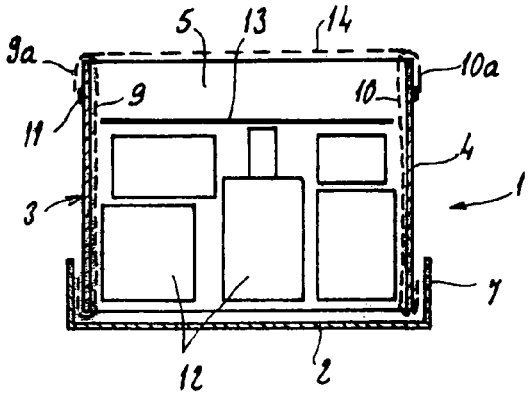

Next, and in all cases, as FIG. 6 shows, a third sheet 14, made from heat-shrinkable plastic, of the same nature as the two abovementioned sheets 9 and 10, is supplied and positioned. Of rectangular shape, the additional heat-shrinkable sheet 14 is supplied at the level of the upper edge of the lateral band 3 such that the two opposing longitudinal edges of this sheet 14 are placed above the upper folds of the first two sheets 9 and 10, which are still held folded down over the upper edges of the two opposing faces 4 of the lateral band 3. The next step is to weld the longitudinal edges of the additional sheet 14 over the corresponding upper fold zones of the first two sheets 9 and 10. Thus, the three sheets 9, 10 and 14 are joined as a single, continuous strip of heat-shrinkable film extending over the upper opening of the box 1.

Figure 7:
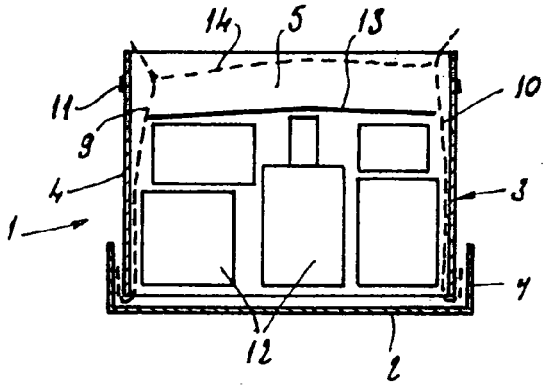
Figure 8:
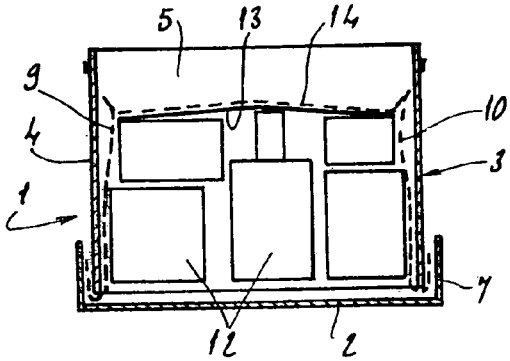
Figure 9:
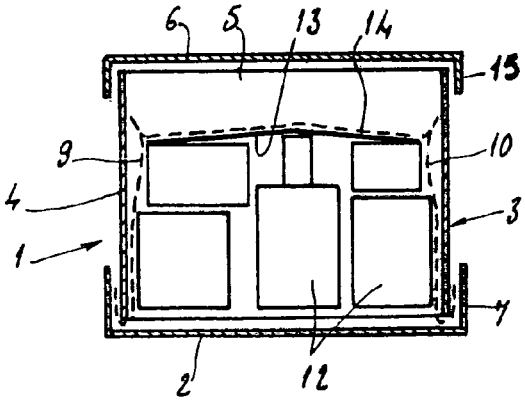

In the next step, illustrated in FIGS. 7 and 8, the film previously formed by the joining of the three heat-shrinkable sheets 9, 10 and 14 is shrunk using appropriate heating means. The diagram of FIG. 7 shows the start of the shrinkage process, just after the removal or tearing-off of the links 11 previously made between the first two sheets 9 and 10 and the faces 4 of the lateral band 3. The diagram of FIG. 8 shows the end of the shrinkage process, the film constituted by the joining of the three sheets 9, 10 and 14 then tightening over all the products 12, with optional insertion of the heat-protection sheet 13, the products 12 then being immobilized inside the box 1.

With reference to this shrinkage operation, the following will be noted:

if sheets 9, 10 and 14 made from uniaxially oriented heat-shrinkable plastic, such as uniaxially oriented polyethylene, are used, the orientation directions of these three sheets 9, 10 and 14 are coordinated, so as to obtain the desired shrinkage, in the transverse direction;

despite the initial length of the strip constituted by the joining of the three sheets 9, 10 and 14, the shrinkage ratio of the film is sufficiently large (of the order of 5 to 1) to guarantee, after shrinkage, the application and tightening of the film over all the products 12, even if all these products are of low height, which in all cases guarantees suitable immobilization of said products 12;

if a heat-protection sheet 13 is incorporated, said sheet provides efficient protection for the products 12 against the effects of heat during the film-shrinkage operation, which is important for products 12 that should not be exposed to excessive heat.

Lastly, after immobilization of the products 12, the box 1 is closed by the positioning, at its top, of the cover 6. This cover 6 is, in particular, adhesively bonded to the top of the lateral band 3 via its longitudinal flaps 15 and transverse flaps 16 (see FIGS. 5, 3 and 9).

Figure 10:
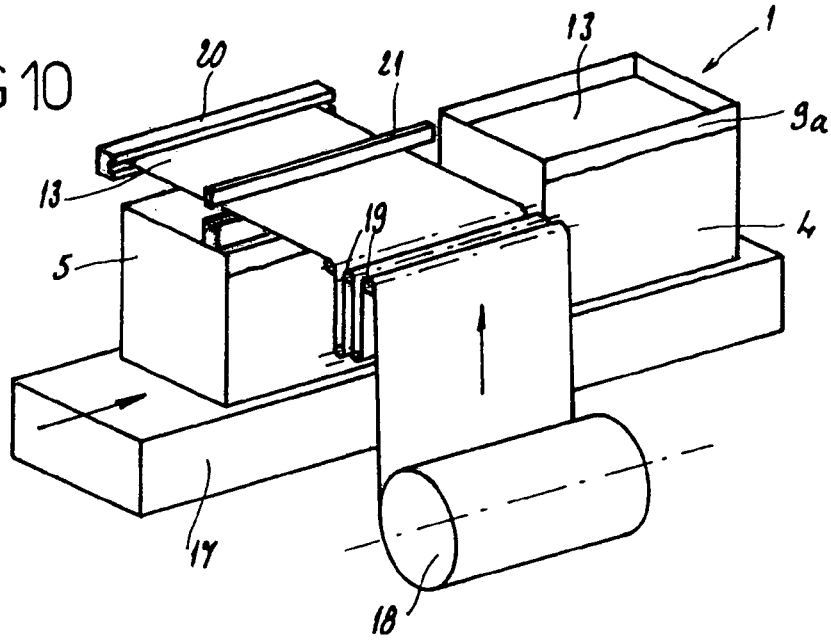
FIG. 10 is a highly diagrammatic perspective view of the station for unwinding and positioning the heat-protection sheet.
Figure 11:
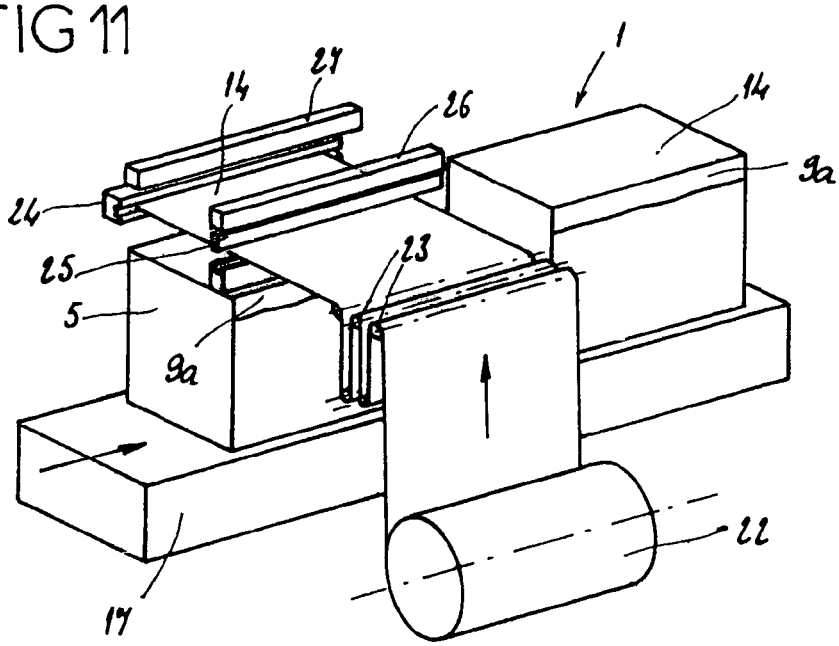
FIG. 11 is a highly diagrammatic perspective view of the station for unwinding and positioning a third heat-shrinkable sheet.

The operations of filling the box 1, of immobilizing the products 12 and of finishing the formation of the box 1 are carried out along a conveyor 17. FIGS. 10 and 11 show two portions of this conveyor 17 on which, respectively, the heat-protection sheet 13 is positioned and then the additional sheet 14 made from heat-shrinkable plastic is positioned.

The station for positioning the heat-protection sheet 13, shown in FIG. 10, provides for the unwinding of protective sheet from a reel 18 arranged on one side of the conveyor 17. In particular, this station comprises rollers 19 for guiding the unwound sheet 13, a component 20 for drawing the end of this sheet 13, and a component 21 for cutting said sheet 13, which cuts it into rectangular portions suited to the dimensions of the box 1.

In a fairly similar manner, and as shown in FIG. 11, the station for positioning the additional sheet 14 made from heat-shrinkable plastic, placed downstream of the station for positioning the protective sheet, provides for unwinding of heat-shrinkable film from a reel 22 arranged on one side of the conveyor 17. In particular, this station comprises rollers 23 for guiding the unwound sheet 14, a component 24 for drawing the end of this sheet 14, and a component 25 for cutting said sheet 14, which cuts it into rectangular portions of suitable dimensions. Moreover, the station comprises means designed to weld the additional sheet 14 over the first two sheets 9 and 10 already placed in position, these welding means being, for example, two parallel heating ramps 26 and 27.

The following would not constitute a departure from the scope of the invention as defined in the appended claims:

temporarily fixing the first two heat-shrinkable sheets over the outer sides of the corresponding faces of the lateral band, by any appropriate means, or even dispensing with fixing of this type and being content with the relative holding provided simply by the weight of the hanging parts of these sheets;

applying the same system to packaging using more than two heat-shrinkable sheets joined to the bottom of the cardboard box, provided use is also made of an additional heat-shrinkable sheet welded to the first sheets;

applying the system to packaging in which the first heat-shrinkable sheets are joined to the bottom of the cardboard box by any attachment method and at every appropriate point;

using a heat-protection sheet in any appropriate material and, optionally, dispensing with this protective sheet or combining it with the additional heat-shrinkable sheet;

in the method, welding the additional sheet to the first sheets not at the level of the upper edge of the lateral band of the box (as illustrated in FIG. 6), but making this weld either laterally against the outer faces of the band or inside the box, above the products just inserted therein; in this latter case, the first sheets are supplied toward the inside of the box before the additional sheet is also supplied thereto (thus positioned in a similar manner to the heat-protection sheet);

adapting or modifying the tooling used, for example by replacing the two successive stations, for positioning the heat-protection sheet and then positioning the additional heat-shrinkable sheet (according to FIGS. 10 and 11) with a single machine combining the functions of these two stations, or supplying the additional heat-shrinkable sheet by unwinding and longitudinal advance above the conveyor (instead of a lateral and transverse feed).

The invention claimed is:

1. A method for forming packaging for products with a shrink film, comprising in succession:

starting with a preformed cardboard box;

folding initially free parts of heat-shrinkable sheets, that are—connected to a joint between a base—of the box and a lateral band of the box, over an upper—edge of faces—of the lateral band—of the box;

inserting products—to be packaged inside the box;

placing an additional heat-shrinkable sheet over the box;

welding the additional heat-shrinkable sheet to the heat-shrinkable sheets—at a level of the upper edge of the faces—of the lateral band—or over the products—arranged inside the box, so as to form a single continuous film; and shrinking the single continuous film by heating, so as to tighten the single continuous film over all of the products—arranged inside the box.

2. The method according to claim 1, wherein the steps of welding the additional heat-shrinkable sheet—to the heat-shrinkable sheets—and shrinking the single continuous film are carried out simultaneously.

3. The method according to claim 1, wherein a heat-protection sheet is placed inside the box—after inserting the products—to be packaged and before placing the additional heat-shrinkable sheet.

4. The method according to claim 3, wherein the heat-protection sheet, is supplied by unwinding from a reel—of protective strip and by cutting the strip above a location receiving the box.

5. The method according to claim 4, wherein the heat protection sheet is supplied by cutting the strip above a conveyor.

6. The method according to claim 1, wherein the free parts—of the heat-shrinkable sheets folded over the upper edge of the faces of the lateral band of the box are held temporarily—against an outside of the faces—by adhesive bonding or by pinching, at least during the step of inserting the products.

7. The method according to claim 6, wherein at least one part of the free parts—of the heat-shrinkable sheets are held temporarily against the outside of the faces—of the lateral band by pinching points resulting from slits, notches or impressions produced in an upper zone of the faces of the lateral band.

8. The method according to claim 1, wherein the additional heat-shrinkable sheet—is supplied by unwinding from a reel—of heat-shrinkable film and by cutting the film above a location receiving the box.

9. The method according to claim 8, wherein the unwinding and cutting of the film stored on the reel—take place at a work station that also carries out welding of the additional heat-shrinkable sheet—to the heat-shrinkable sheets.

10. The method according to claim 8, wherein the additional heat-shrinkable sheet is supplied by cutting the film above a conveyor.

* * * * *